US006811429B2

(12) United States Patent
Recktenwald et al.

(10) Patent No.: US 6,811,429 B2
(45) Date of Patent: Nov. 2, 2004

(54) LOW NOISE IDC TERMINAL/PIN ARRANGEMENT FOR FLAT RIBBON CABLE CONNECTORS

(75) Inventors: Willi Recktenwald, Holzgerlingen (DE); Klaus Thumm, Pfalzgrafenweiler (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/193,536

(22) Filed: Jul. 11, 2002

(65) Prior Publication Data

US 2003/0045162 A1 Mar. 6, 2003

(30) Foreign Application Priority Data

Aug. 31, 2001 (EP) ..... 01120947

(51) Int. Cl.[7] ..... H01R 4/24; H01R 4/26; H01R 11/20

(52) U.S. Cl. ..... 439/405; 439/497; 439/941

(58) Field of Search ..... 439/405, 497, 439/404, 941

(56) References Cited

U.S. PATENT DOCUMENTS 3,434,093 A * 3/1969 Wedekin ..... 439/404
3,930,708 A * 1/1976 Wedekind et al. ..... 439/397
4,850,887 A 7/1989 Sugawara ..... 439/108
6,077,105 A * 6/2000 Jochen et al. ..... 439/497
6,368,148 B1 * 4/2002 Fogg et al. ..... 439/497
6,371,793 B1 * 4/2002 Doorhy et al. ..... 439/404

FOREIGN PATENT DOCUMENTS

EP 0 859 433 A1 8/1998
JP 06104030 4/1994

* cited by examiner

*Primary Examiner*—Javaid H. Nasri
(74) *Attorney, Agent, or Firm*—Floyd A. Gonzalez

(57) ABSTRACT

A cable connector assembly and method for making, wherein the assembly connects to a flat ribbon cable having a plurality of conductors and electrical insulation about the conductors. The cable connector assembly includes a plurality of electrical contacts, each including a terminal configured to connect to at least one of the conductors of the flat ribbon cable directly through the electrical insulation to form an electrical junction. Each contact is configured to electrically connect to an external member. The cable connector assembly has a housing for holding the contacts arranged in a first row and as second row where the contacts in the rows form a grid and are connected in an offset manner to minimize cross talk.

11 Claims, 4 Drawing Sheets

LOW NOISE IDC TERMINAL/PIN ARRANGEMENT FOR FLAT RIBBON CABLE CONNECTORS

BACKGROUND OF THE INVENTION

The present invention relates to a multiconductor electrical cable connector and, more particularly, to IDC (insulation displacement crimp) connector assemblies for a flat ribbon-like multiconductor electrical cable.

Since individual manual connection of each conductor in a multiconductor electrical cable, which usually has more than three conductors and as many as eighty or more conductors therein, would be a difficult and tedious task. Therefore, a number of specialized connectors have been developed for simultaneously connecting each of the plural conductors to those of another multiconductor electrical cable via another connector, for example, to a plural signal input terminal of a computer or the like, to conductive paths on a printed circuit board or the like, etc. Typically, these specialized connectors include multiple housing parts between which the cable is clamped, and usually before or during that clamping the multiple contacts of the connector puncture the electrical insulation of the cable to connect with respective conductors therein. The housing parts are mechanically secured in clamping engagement with the cable, and strain relief is usually provided by the clamping strength and/or by the terminal parts of the contacts pierced through the cable insulation.

From the U.S. Pat. No. 4,824,394 an IDC connector with rotated conductor pairs and strain relief base molded onto cable is known. The IDC connector is formed by a cable termination assembly that comprises a generally flat electrical insulation. The cable has got a longitudinal extent and a planar extent. At least one pair of said conductors include connecting portions rotated relative to each other about an axis generally parallel to the longitudinal extent of the cable and aligned with respect to one another in a direction generally perpendicular to the planar extent of the cable. The conductors of said pair include an area of rotation where said conductors are so rotated. At least two electrical contacts each include terminal means for connecting with the connecting portion of a respective one of said pair of conductors and connecting means for connecting with an external electrically conductive member and a strain relief body is molded directly to said cable including the area of rotation of said pair of conductors.

The U.S. Pat. No. 4,030,799 shows a multiconductor electrical cable termination. The multiconductor electrical cable termination is formed as an integral structural combination of the multiconductor electrical cable, the plurality of electrical contacts, and a housing part that is molded about at least a portion of each of the contacts and a portion of the cable. Each contact forms a junction with a respective conductor of the cable, and the integral housing part is molded under elevated temperature and pressure conditions so that each of the junctions is substantially fully encapsulated by at least one of the cable insulation and the molded body part and, thus, maintained relatively free of moisture and oxygen. The terminal portion of each electrical contact preferably extends fully through the cable insulation, and openings provided in the molded housing part offer access to the ends of those terminal portions for test probing thereof. Furthermore, the terminal portion of each electrical contact is in the same plane and is offset with respect to the contacting portion thereof. The electrical contacts are arranged in a forward row and a rearward row. In the forward row they have their terminal portions offset to the left with respect to their contacting portions, and in the rearward row they have their terminal portions offset to the right with respect to the contacting portions. This offset configuration of the electrical contacts allows them to be of reasonable size and strength while the contacting portion of each electrical contact in one row is directly aligned with the contacting portion of an opposite electrical contact in the other row and with each of the relatively closely positioned parallel conductors being connected to only a single respective electrical contact.

In computer systems there is an increasing need for cables and connectors providing a high bandwidth and a high count of signal lines. Flat ribbon cables provide a high count of signal lines having a suitable high frequency behavior. Therefore, more and more flat ribbon cables are employed in such high frequency environments, e.g., as a connection for system-level interfacing between a computer and devices including hard disks, floppy disks, CD-ROM, printers and scanners, such as the high density 50 pin SCSI (Small Computer System Interface) 2 cable/connector. In order to improve the high frequency behavior of the cable, shieldings are provided to protect the electrical signals being transmitted through the cable from electromagnetic interference.

The noise caused in a cable can further be reduced by only using every other conductor in a flat ribbon cable to transmit a signal. The remaining conductors are functioning as ground lines in order to further shield the signal lines from each other. Hence, two adjacent conductors never carry signal lines, instead, signal lines and ground lines alternate, e.g., ground-signal-ground-signal and so on. However, reaching the connector most of the effort spend to improve the high frequency behavior is lost, since the cross talk of the available connectors are too high for a use in a high frequency environment.

SUMMARY OF THE INVENTION

Starting from this, the object of the present invention is to provide a cable connector assembly having an improved high frequency behavior, i.e., a cable connector assembly having a low noise characteristic.

According to the present invention a cable connector assembly for being connected to a flat ribbon cable containing a plurality of conductors is provided. The cable connector assembly comprises a plurality of electrical contacts arranged in a first row and a second row, whereby the arrangement of the electrical contacts forms an orthogonal grid. Assuming said plurality of conductors being consecutively numbered 1 to N, said electrical contacts being arranged in a way that an electrical contact associated to an odd numbered conductor has got adjacent electrical contacts in the same row and an electrical contact at the same position in the other row that each are associated to even numbered conductors.

In other words, the electrical contacts are being arranged in a way that the electrical contact associated to one conductor is spaced further apart to the electrical contact associated to the respective next but one neighboring conductor, so that cross talk is reduced when having every other conductor assigned to a signal line and the remaining conductors to ground lines.

Hence, according to the present invention a cable connector assembly for being connected to a flat ribbon cable including a plurality of conductors and electrical insulation about said conductors maintaining the latter electrically insulated from each other. The cable connector assembly comprises a plurality of electrical contacts, each including terminal means being configured to connect at least one of said conductors directly through said electrical insulation to form an electrical junction, and contacting means on each of said electrical contacts being configured to electrically connect each of said electrical contacts to an external member. It further comprises a housing for holding said contacting means arranged in a first row and a second row forming an orthogonal grid. Assuming the plurality of conductors being consecutively numbered 1 to N, said electrical contacts being formed so that such terminal means being associated with odd-numbered conductors being respectively connected with every other contacting means of said first row and every other contacting means of the second row, being offset by one, whereby such arrangement causes each conductor being space further apart to its next but one neighboring conductor so that cross talk is reduced when having every other conductor assigned to a signal line and the remaining conductors to ground lines.

The advantage is that a good high frequency behavior is provided by just providing in average one ground line per signal line and having maximum separation of signal lines from each other in the connector itself.

Furthermore, the present invention allows to use flat ribbon cables in areas in which up to know only more expensive cables could be used, such as coax cable, but the invention may not be a substitute for coax cables in general. The costs may be significantly reduced for a respective connection.

Advantageously, a connector in accordance with the present invention still meets the form requirements set by the International Electromechanical Commission (IEC), i.e., it is still form fit compatible, while providing a significantly improved crosstalk behavior between adjacent signal lines.

BRIEF DESCRIPTION OF THE DRAWINGS

These and other objects will be apparent to one skilled in the art from the following detailed description of the invention taken in conjunction with the accompanying drawings in which.

DESCRIPTION OF THE PREFERRED EMBODIMENT

Figure 1:
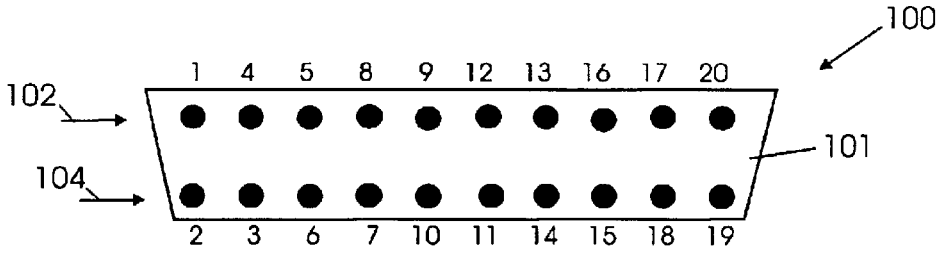
FIG. 1 shows a bottom view on the pin face of a low noise IDC terminal arrangement in accordance with the present invention.

Now with reference to FIG. 1, there is depicted a bottom view on the pin face of a low noise IDC (insulation displacement crimp) terminal arrangement 100 in accordance with the present invention. The terminal arrangement 100 is connected to a flat ribbon cable (not shown) containing a plurality of conductors (not shown) and comprises a plurality of electrical contacts numbered 1 to 20. A housing 101 is provided for holding the electrical contacts arranged in a first row as indicated by arrow 102 and a second row as indicated by arrow 104, whereby the arrangement of the electrical contacts are forming an orthogonal grid.

Assuming that the plurality of conductors are consecutively numbered 1 to N, the electrical contacts 1 to 20 being arranged in a way that each of the electrical contacts 1 to 20 are configured to establish an electrical connection the particular conductor having the same number associated. That is, in the drawing of FIG. 1, the first conductor of the flat ribbon cable connects to the left most electrical contact in the first row (arrow 102) also marked by number 1. Whereas the second conductor of the flat ribbon cable connects to the left most electrical contact in the second row (arrow 104) also marked by number 2. Now, in order to arrange the electrical contacts in a way that each conductor is spaced further apart to its next but one neighboring conductor so that cross talk is reduced when having every other conductor assigned to a signal line and the remaining conductors to ground lines, the third conductor of the flat ribbon cable connects to the second electrical contact from the left in the second row (arrow 104) also marked by number 3. Whereas the fourth conductor of the flat ribbon cable connects to the second electrical contact from the left in the first row (arrow 102) also marked by number 4 and so on. Thus, the increasing numbers of the respective conductors are meandering from left to right alternating between the first and the second row.

Figure 2:
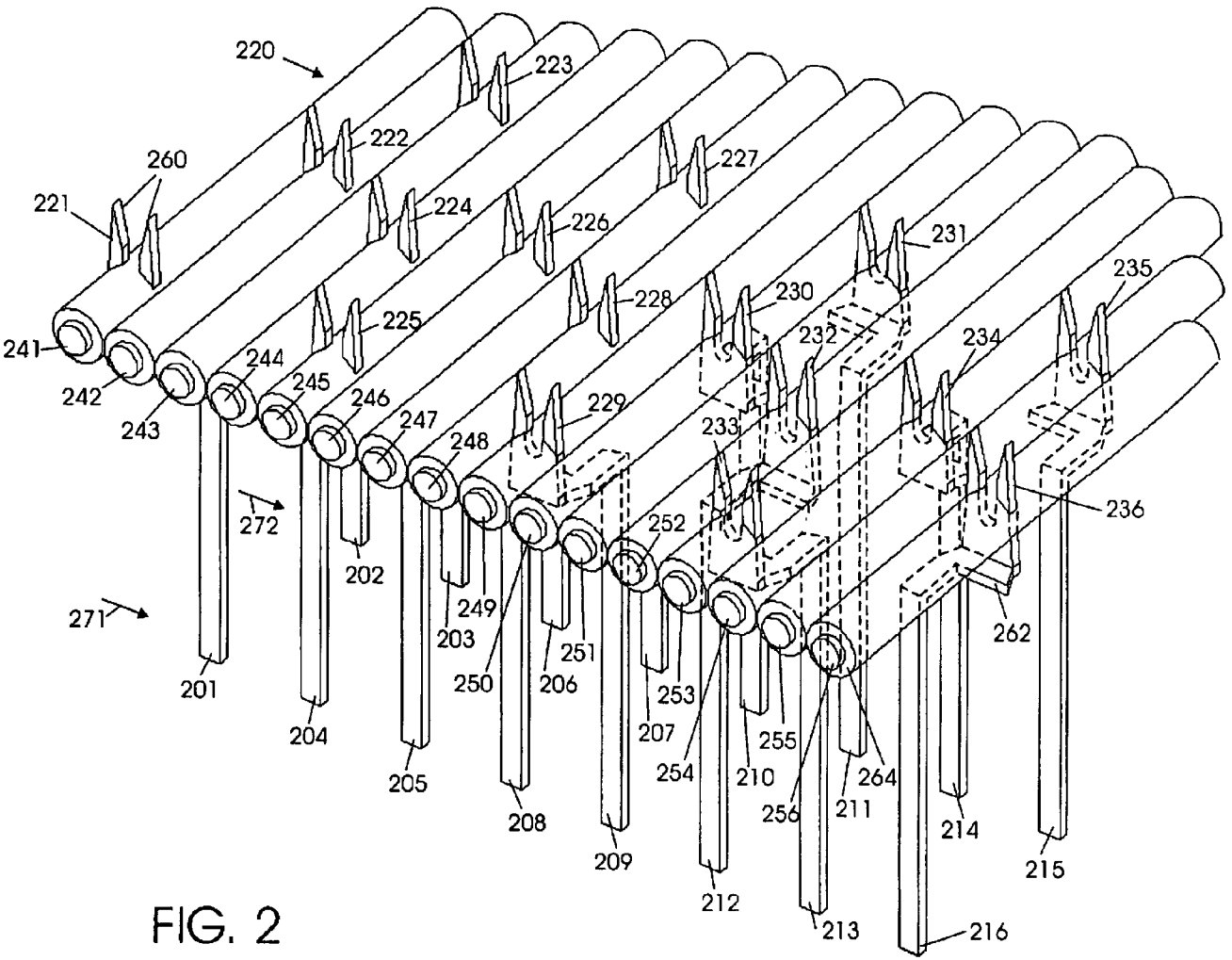
FIG. 2 shows a perspective view of a set of electrical contacts connected to conductors of a flat ribbon cable in an arrangement according to a first embodiment of the present invention.

With reference now to FIG. 2, there is depicted a perspective view of a set of electrical contacts 201 to 216 in an arrangement according to a first embodiment of the present invention. The electrical contacts 201 to 216 are part of a multiconductor electrical cable connector. The cable connector include a multiple conductor electrical cable 220, a plurality of electrical contacts 201 to 216 for connection at terminal portions 221 to 236 to the respective conductors 241 to 256 of the cable, and a housing (not shown), whereby the terminal portions 221 to 236 belong to the electrical contacts 201 to 216 and are electrically connected to the conductors 241 to 256, respectively.

The terminal portions 221 to 236 of each electrical contact 201 to 216 preferably include a pair of elongate prong-like arms 260 commonly supported from a base portion 262 and defining a relatively narrow slot there between. The ends of the arms 260 remote from the base portion 262 preferably are tapered or chamfered to define an entranceway into the narrow slot and to form generally pointed tips to pierce easily through the cable insulation 264. The width of the narrow slot is preferably narrower than the normal diameter of one of the conductors 241 to 256. Therefore, as a typical electrical contact 201 is joined with the cable 220 by urging the two toward each other, the pointed tips pierce through the insulation 264 while the wide chamfered entranceway guides the conductor 241 into the narrow slot. As the conductor 241 enters the slot, it is somewhat flattened squeezed to provide a relatively enlarged surface area of a gas tight engagement or connection with the two arms 260.

The terminal portions 260 of each the electrical contacts 201, 205, 209 and 213 are in the same plane. The same applies to the terminal portions of electrical contacts 202, 206, 210 and 214, as well as to electrical contacts 203, 207, 211 and 215 as well as to electrical contacts 204, 208, 212 and 216. Preferably, the conductors 242, 244, 246, 248, 250, 252, 254 and 256 being connected to electrical contacts 202, 204, 206, 208, 210, 212, 214 and 216, respectively, are tight to ground. Hence, the arrangement of the terminal portions of such electrical contacts form a shielding separating the terminal portions of electrical contacts 201, 205, 209 and 213 from the terminal portions of electrical contacts 203, 207, 211 and 215, which reduces the cross talk and allows to use the cable connector for higher frequencies.

From the illustration of FIG. 2 it can be seen that the electrical contacts 201 to 216 are arranged in a way that an electrical contact associated to an odd numbered conductor 241 to 256 has got adjacent electrical contacts in the same row and an electrical contact at the same position in the other row that each are associated to even numbered conductors. For example, electrical contact 203 is associated to odd numbered conductor 243. It has got adjacent electrical contacts 202 and 206 in the same row and an electrical contact 204 at the same position in the other row that each are associated to even numbered conductors. In other words, the electrical contact 203 associated to conductor 243 is arranged to be spaced further apart to the electrical contact 201 (or 205) associated to the respective next but one neighboring conductor 241 (or 245). Therefore, cross talk is reduced in the cable connector according to the present invention, when every other conductor is assigned to a signal line and the remaining conductors to ground lines.

To abstract, the electrical contacts are arranged in a first row (arrow 271) and a second row (arrow 272). Furthermore, they are formed so that such terminal portions 260 being associated with odd-numbered conductors 241, 243, 245, . . . , 255 being respectively connected with every other electrical contact of said first row (cf. 201, 205, 209 and 213) and every other contacting means of the second row (cf. 203, 207, 211 and 215), being offset by one.

Moreover, while the invention is illustrated and described above with reference to multiconductor electrical cable connector located at an end of the multiconductor electrical conductor, it will be apparent that such a connector also may be provided in accordance with the invention at a location on a multiconductor electrical cable intermediate the ends thereof.

Figure 3:
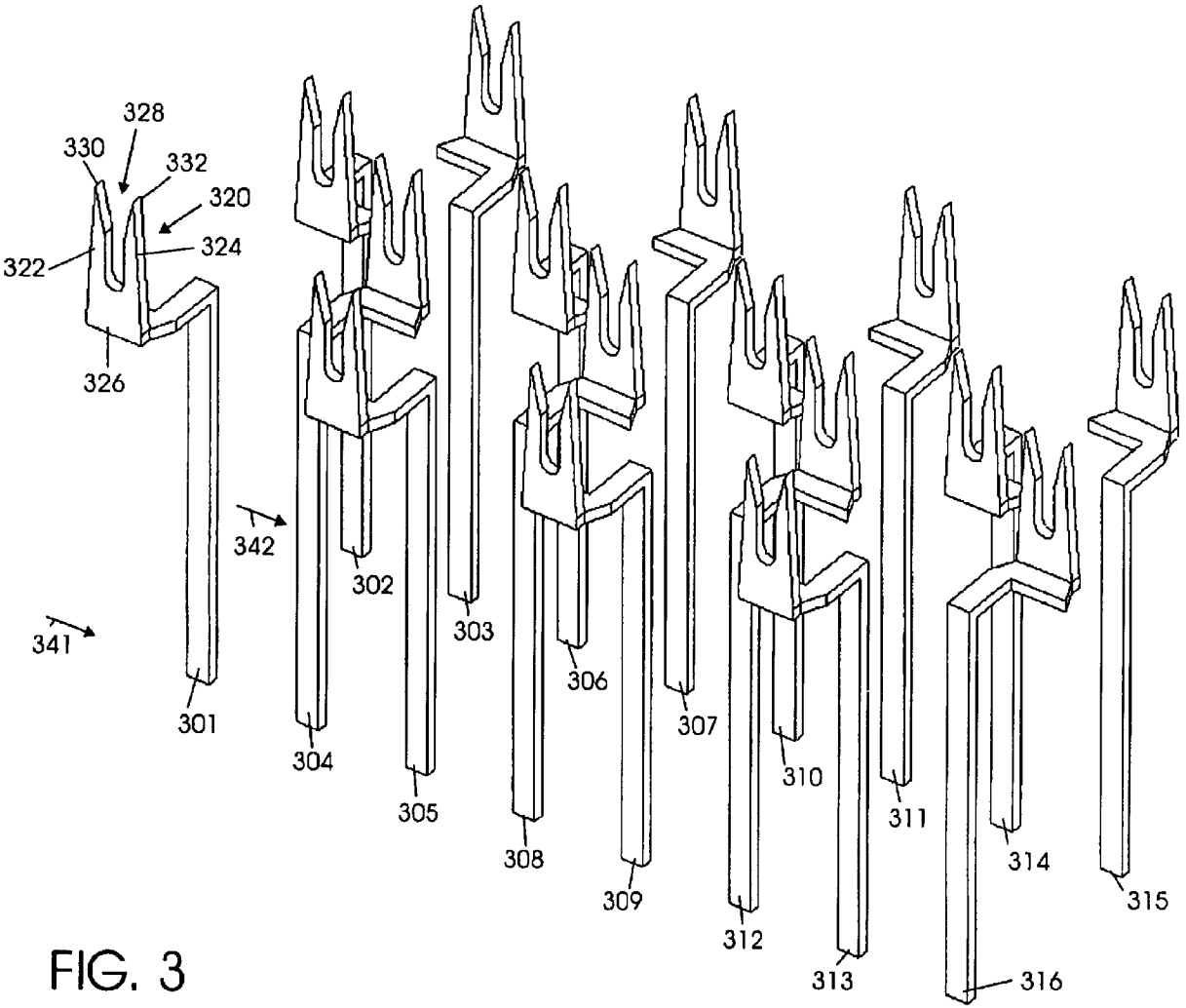
FIG. 3 shows a perspective view of the set of electrical contacts as shown in FIG. 2 without showing the flat ribbon cable.

Now with reference to FIG. 3, there is shown a perspective view of the set of electrical contacts 301 to 316 as shown in FIG. 2 without depicting the flat ribbon cable, whereby the electrical contacts 301 to 316 of FIG. 3 correspond to the electrical contacts 201 to 216 of FIG. 2.

Each electrical contact 301 to 316 is provided with a terminal portions 320. The terminal portion 320 of each electrical contact 301 to 316 preferably include a pair of elongate prong-like arms 322, 324 commonly supported from a base portion 326 and defining a relatively narrow slot 328 there between. The ends of the arms 322, 324 remote from the base portion 326 preferably are tapered or chamfered to define an entranceway into the narrow slot 328 and to form generally pointed tips 330, 332 to pierce easily through a cable insulation.

The electrical contacts 301 to 316 are arranged in a first row (arrow 341) and a second row (arrow 342). As it can be seen in particularly in FIG. 3, the electrical contacts 301, 305, 309 and 313 in the first row (arrow 341) have their terminal portions offset away from the second row (arrow 342) with respect to their contacting portions, i.e., the portion aligned in the two rows. Whereas the electrical contacts 304, 308, 312 and 316 in the first row (arrow 341) have their terminal portions offset towards the second row (arrow 342) with respect to their contacting portions. Correspondingly, the electrical contacts 303, 307, 311 and 315 in the second row (arrow 342) have their terminal portions offset away from the first row (arrow 341) with respect to their contacting portions, whereas the electrical contacts 302, 306, 310 and 314 in the second row (arrow 342) have their terminal portions offset towards the first row (arrow 341) with respect to their contacting portions.

Each of the contact terminal arms 322, 324 is preferably sufficiently long to extend fully through the cable (cf. FIG. 2) with a portion, for example, including the pointed ends 330, 332, being exposed beyond the plane of the cable (cf. FIG. 2).

Figure 4:
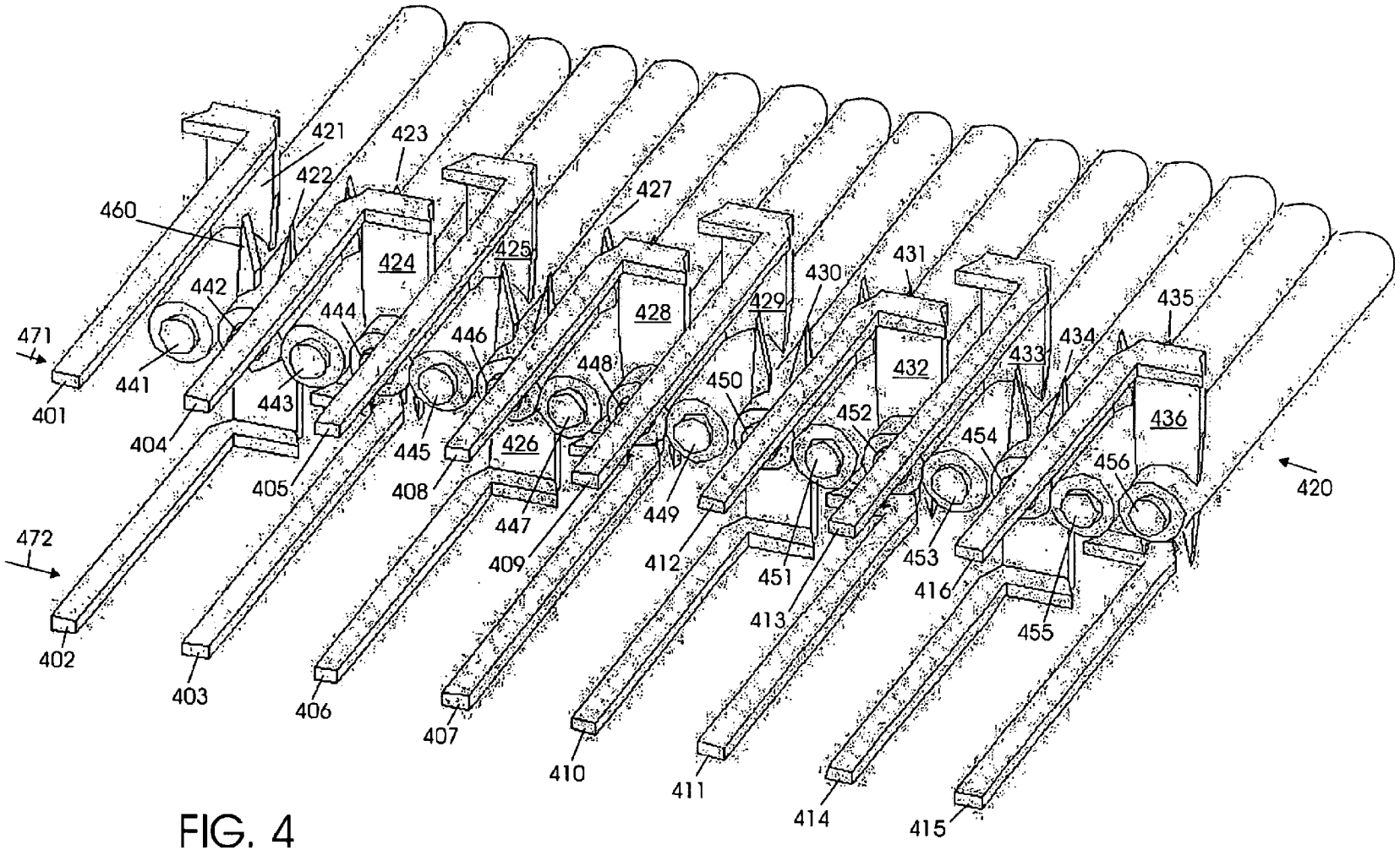
FIG. 4 shows a perspective view of a set of electrical contacts connected to conductors of a flat ribbon cable according to a second embodiment of the present invention.

Finally, with reference to FIG. 4, there is depicted a perspective view of a set of electrical contacts connected to conductors of a flat ribbon cable according to a second embodiment of the present invention. The electrical contacts 401 to 416 are part of a multiconductor electrical cable connector. As in the previous embodiment, the electrical contacts 401 to 416 are arranged in a first row (arrow 471) and a second row (arrow 472). The cable connector include a multiple conductor electrical cable 420, a plurality of electrical contacts 401 to 416 for connection at terminal portions 421 to 436 to the respective conductors 441 to 456 of the cable, and a housing (not shown), whereby the terminal portions 421 to 436 belong to the electrical contacts 401 to 416 and are electrically connected to the conductors 441 to 456, respectively.

The terminal portions 421 to 436 of each electrical contact 401 to 416 preferably include a pair of elongate prong-like arms as known from the first embodiment described above.

The terminal portions 421 to 436 of each the electrical contacts 401, 405, 409 and 413 are in the same plane approaching the flat ribbon cable 420 from the top. The same applies to the terminal portions of electrical contacts 404, 408, 412 and 416. In contrary, the electrical contacts 402, 406, 410 and 414 as well as the electrical contacts 403, 407, 411 and 415 approach the flat ribbon cable from below, whereby each set of electrical contacts are again arranged that the respective terminal portions are placed in the same plane. Thus, the electrical contacts shown in FIG. 4 differ only in such a way from the electrical contacts according to the first embodiment that the depicted arrangement is suitable for a connector having the electrical contacts pointing in the same direction as the conductors of the flat ribbon cable.

However, from the illustration of FIG. 4 it can be seen that the electrical contacts 401 to 416 itself are arranged in a the same way as explained for the first embodiment with regard to FIGS. 2 and 3. Thus, electrical contact 403 associated to odd numbered conductor 443 has got adjacent electrical contacts 402 and 406 in the same row and an electrical contact 404 at the same position in the other row that each are associated to even numbered conductors. In other words, the electrical contact 403 associated to conductor 443 is arranged to be spaced further apart to the electrical contact 401 (or 405) associated to the respective next but one neighboring conductor 441 (or 445). Therefore, cross talk is reduced in the cable connector according to the present invention, when every other conductor is assigned to a signal line and the remaining conductors to ground lines.

While the preferred embodiment of the invention has been illustrated and described herein, it is to be understood that the invention is not limited to the precise construction herein disclosed, and the right is reserved to all changes and modifications coming within the scope of the invention as defined in the appended claims.

What is claimed is:

1. A cable connector assembly for being connected to a flat ribbon cable containing a plurality of conductors, said cable connector assembly comprising:

a plurality of electrical contacts arranged in a first row and a second row forming a grid and having a first offset and a second offset, said plurality of conductors being consecutively numbered 1 to N, said electrical contacts first offsets being arranged in a way that an electrical contact associated with an odd numbered conductor has adjacent electrical contacts in the same row, and an electrical contact at the same position in the other row is associated with even numbered conductors and said electrical contacts second offsets being arranged in a way that adjacent electrical contacts in the same row are spaced away from each other.

2. The cable connector assembly of claim 1 wherein said second offsets of said electrical contacts are arranged in a way that the electrical contact associated to one conductor is spaced further apart from the electrical contact associated to the respective next-but-one neighboring conductor so that cross talk is reduced when every-other conductor is assigned to a signal line and the remaining conductors are assigned to ground lines.

3. The cable connector assembly according to claim 2 wherein the electrical contacts are configured to electrically connect to an external member.

4. The cable connector assembly according to claim 2 wherein each electrical contact is provided with terminal means.

5. A cable connector assembly for being connected to a flat ribbon cable including a plurality of conductors and having electrical insulation about said conductors maintaining the latter electrically insulated from each other, the cable connector assembly comprising:

a plurality of electrical contacts each have a first offset and a second offset, each further including terminals being configured to connect at least one of said conductors directly through said electrical insulation to form an electrical junction, and contacting portions on each of said electrical contacts being configured to electrically connect each of said electrical contacts to an external member, and a housing for holding said contacting portions arranged in a first row and a second row forming a grid, wherein, when the plurality of conductors is consecutively numbered 1 to N, said first offset of said electrical contacts are arranged so that such terminals being associated with odd-numbered conductors are respectively connected with every-other contacting portion of said first row and every-other contacting portion of the second row, being offset by one, and said second offset of said electrical contacts are arranged such that each contact is spaced away from the adjacent contact in the same row whereby such arrangement causes each terminal being spaced further apart from its next-but-one neighboring terminal so that cross talk is reduced when every-other terminal is assigned to a signal conductor and the remaining terminals are assigned to ground conductors.

6. The cable connector assembly according to claim 5, wherein the terminals of each electrical contact includes a pair of elongate prong-like arms commonly supported from a base portion and defining a relatively narrow slot there between.

7. The cable connector assembly according to claim 5 wherein every-other electrical contact in the first row have their terminal means offset away from the second row with respect to their portion aligned in the two rows.

8. The cable connector assembly according to claim 7 wherein remaining said every-other electrical contact have their terminal portions offset towards the second row with respect to their contacting portions.

9. The cable connector assembly according to claim 8, wherein every-other electrical contact in the second row have their terminal portions offset away from the first row with respect to their contacting portions, whereas said remaining electrical contacts in the second row have their terminal portions offset towards the first row with respect to their contacting portions.

10. A method of forming a cable connector assembly for being connected to a flat ribbon cable containing a plurality of conductors, said method comprising:

arranging a plurality of electrical contacts having a first offset and a second offset in a first row and a second row forming a grid, said plurality of conductors being consecutively numbered 1 to N;

arranging the first offsets of said electrical contacts in a way that an electrical contact associated with an odd numbered conductor has adjacent electrical contacts in the same row, and an electrical contact at the same position in the other row is associated with even numbered conductors; and arranging the second offsets of said electrical contacts in a way that adjacent electrical contacts in the same row are spaced away from each other.

11. The method of claim 10 further comprising arranging the second offsets of said electrical contacts in a way that the electrical contact associated to one conductor is spaced further apart from the electrical contact associated to the respective next-but-one neighboring conductor so that cross talk is reduced when every-other conductor is assigned to a signal line and the remaining conductors are assigned to ground lines.

* * * * *